United States Patent [19]

Cellone et al.

[11] 4,367,284

[45] Jan. 4, 1983

[54] PHOTOGRAPHIC ELEMENTS WITH IMPROVED SURFACE CHARACTERISTICS

[75] Inventors: Luigi Cellone, Albisola Mare; Angelo Vallarino, Spotorno; Roberto Leoncavallo, Carcare, all of Italy

[73] Assignee: Minnesota Mining and Manufacturing Company, St. Paul, Minn.

[21] Appl. No.: 267,073

[22] Filed: May 26, 1981

[30] Foreign Application Priority Data

May 26, 1980 [IT] Italy ..... 48797 A/80

[51] Int. Cl.[3] ..... G03C 5/26

[52] U.S. Cl. ..... 430/539; 430/950; 430/961

[58] Field of Search ..... 430/961, 950, 628, 539

[56] References Cited

U.S. PATENT DOCUMENTS 3,203,804 8/1965 Cohen et al. ..... 430/628
3,411,907 11/1968 Whitmore et al. ..... 430/950
3,877,942 4/1975 Nagatomo et al. ..... 430/950
3,923,517 12/1975 Yamamoto et al. ..... 430/950

FOREIGN PATENT DOCUMENTS 1106717 3/1968 United Kingdom .

*Primary Examiner*—Mary F. Downey
*Attorney, Agent, or Firm*—Cruzan Alexander; Donald M. Sell; Mark A. Litman

[57] ABSTRACT

It is generally undesirable to have surfaces on photographic elements which are highly reflective and therefore reduce the attractiveness of the image. One of the traditional means of correcting this reflectance is to coat the developed film or print with an anti-reflective coating or to place a glass cover over the imaged photographic element where the glass itself has an anti-reflective surface.

According to the present invention, an anti-reflective surface may be provided within the photographic element itself by including within a top coat gelatin layer a combination of a first water-soluble soft matting agent incompatible with gelatin and a second water-insoluble soft matting agent.

15 Claims, No Drawings

PHOTOGRAPHIC ELEMENTS WITH IMPROVED SURFACE CHARACTERISTICS

DESCRIPTION

This invention relates to silver halide photographic elements with improved surface characteristics, to coating compositions of use in manufacturing said elements, and to a method for obtaining improved surface characteristics in photographic elements during their manufacture.

Photographic elements consist of one or more gelatin layers containing silver halide emulsions spread over a support. After drying, the emulsion layer is very sensitive to physical abrasion or scratching, and developed silver impressions can form by simple pressure exerted on the silver halide granules. This defect is reduced by the application of a thin protective gelatin layer spread over the outermost emulsion layer. This protective gelatin layer is normally used in all photographic materials. Besides gelatin hardeners and coating aids, one normally incorporates matting agents, the purpose of which is to prevent or control the following mechanical and optical surface characteristics: tendency for the film to become tacky (both in the form of rolls and in sheets); excessive slipperiness; formation of Newton rings; and brightness or excessive reflectance.

Numerous matting agents, both organic and inorganic, have been described and used, but their use either alone or in combination has not enabled both the mechanical and optical surface properties of the aforesaid photographic element to be simultaneously improved, as required.

SUMMARY OF THE INVENTION

It has been found that photographic elements with improved mechanical and optical characteristics can be prepared by modifying the profile of the external protective layer so that it comprises protuberances and, respectively, roughness or rupture obtained by adding two soft matting agents of different solubility characteristics.

DETAILED DESCRIPTION OF THE INVENTION

The present invention relates to a photographic element comprising a support, at least one photosensitive layer of silver halide emulsion in gelatin, and a non-photosensitive external protective gelatin layer, wherein said external protective gelatin layer contains a first water-soluble soft matting agent incompatible with dry gelatin, and an aqueous dispersion of particles of a second water-insoluble soft matting agent.

According to a further aspect, the present invention relates to a method for making the surface of a photographic element non-bright, or non-glare, where this element comprises a support, at least one layer of silver halide emulsion in gelatin, and an external protective gelatin layer, said method consisting of mixing the gelatin solution of the external protective layer with the required matting agents of the finished layer before being spread over the emulsion layer, then spreading the resulting composition over the emulsion layer.

The present invention further relates to a photographic element comprising a support, at least one photosensitive layer of silver halide emulsion in gelatin, and a non-photosensitive external protective gelatin layer, wherein the surface is modified by rupture or roughness caused by the presence of a first water-soluble soft matting agent incompatible with gelatin, and by protuberances caused by the presence of a second water-insoluble soft matting agent, the first matting agent being present in such a quantity as to control the surface reflectance characteristics, and the second matting agent being present in such a quantity as to control the surface friction characteristics.

The present invention relates preferably to a photographic element as heretofore described, with a protective layer having a thickness of between 0.5 and 2.0 micrometers, and more preferably between 0.6 and 1.2 micrometers. The present invention relates still more preferably to a photographic element as heretofore described, wherein said first soft matting agent is polyvinyl alcohol and/or dextran of high molecular weight, and/or said second soft matting agent is polymethylmethacrylate, said first and second matting agents more preferably being present in quantities of 0.1 to 1.3 and 0.02 to 0.15 g per $m^2$ of said protective layer respectively, and still more preferably in quantities of 0.3 to 1.0 and 0.04 to 0.1 g per $m^2$ respectively. Preferably according to one particular aspect, the present invention relates to an element as heretofore defined, wherein said matting agents are present, relative to the gelatin of said protective layer, in proportions of 10% to 90% and 1% to 30% respectively, and more preferably of 20% to 70% and 4% to 10% respectively. Preferably, according to a further particular aspect of the invention, said rupture or roughness produced by said first matting agent is distributed continuously over the surface of the aforesaid element and has a vertical or horizontal dimension of about 0.5 to 4 and preferably 2 microns, and/or the protuberances produced by said second matting agent are distributed discontinuously therein and have a horizontal or vertical dimension of between 1 and 10 micrometers, and more preferably between 2 and 6 micrometers.

The present invention also relates to the aforesaid photographic element, wherein said matting agents are introduced into the protective layer when the emulsion layer contains agents which increase the covering power of the developed silver. In this respect, it has been seen that the surface brightness defect is accentuated in the case of photographic elements which have been covered in those most modern industrial plants characterized by high spreading rates and high drying temperatures, and still more in the case of photographic elements of low silver content in which the covering power of the developed silver is increased by adding to the photographic emulsion special polymer materials known as gelatin extenders, such as the acrylamideacrylic ester copolymers described in Italian Pat. No. 761,724, and the low molecular weight dextran described in U.S. Pat. No. 3,063,383.

According to a further aspect, the present invention relates to an aqueous gelatin spreading composition for photographic use, containing two soft matting agents as surface modifiers, the first being water-soluble and incompatible with the gelatin, and the second being water-insoluble, which after drying the coated layer produce rupture or roughness on the surface, and, respectively, rounded particles which emerge from the coated layer. More particularly, the present invention relates to the aforesaid coating compositions wherein said soft matting agents are present in the described quantity, form and dimensions.

According to a further aspect, the present invention relates to a method for controlling the surface characteristics of a photographic element comprising a support, at least one photosensitive silver halide emulsion layer, and an external protective gelatin layer, said method consisting of adding an aqueous solution of a first soft matting agent incompatible with gelatin and an aqueous dispersion of a second soft matting agent to the gelatin spreading solution of said external protective layer, spreading the resultant spreading composition over the element comprising a support and a silver halide emulsion layer, and drying the layer thus obtained so as to provide a surface comprising rupture or roughness and rounded particles emerging from it, in order to obtain a photographic element as heretofore described.

It has been found that for the purposes of the present invention the two matting agents must be "soft", i.e. have a hardness which does not exceed 4 on the Mohs scale (see *Handbook of Chemistry and Physics,* 52nd Edition, published by The Chemical Rubber Company, page F-18).

More precisely, it has been found that the first soft matting agent must be water-soluble to at least 0.5% by weight at 23° C., and compatible with aqueous gelatin solutions (i.e. not showing phase separation in aqueous solution with the gelatin), but incompatible with the dry gelatin of the protective finishing layer. Polyvinyl alcohols prepared by saponifying polyvinyl acetates and water-soluble when at least 80% of the acetyl groups is saponified have proved useful for this purpose. It has been found that polyvinyl alcohols with at least 88% and preferably at least 98% of the acetyl groups saponified and having a viscosity at 20° C. in a 4% aqueous solution of between 5 and 40 cP and preferably of between 5 and 20 cP are particularly useful for the purposes of the present invention, viscosities higher than 40 cP (e.g. up to 75 cP) being less preferred for the purposes of the present invention as they produce surface defects and excessive turbidity.

The dextran used for the purposes of the present invention can be characterized as a high molecular weight polysaccharide having an empirical formula which includes $C_6H_{10}O_5$ monomer units connected to form glucoside bonds. The preferred dextran according to the present invention has an average molecular weight of about 500,000 and a relative viscosity of 5° at 23° C. when in a 20% mixture with water. It has been found that the high molecular weight dextran useful for the purposes of the present invention must be easily soluble in water (it must have a water solubility at 20° C. of at least 0.5% by weight), be compatible with aqueous gelatin solutions (i.e. so that no phase separation or flocculation occurs when its aqueous solution is added to the aqueous gelatin solution), and be incompatible with the dry gelatin of the protective layer (i.e. distinct phases form).

The invention is not limited to a dextran having a molecular weight of 500,000, and molecular weights less or greater than this (e.g. 100,000 through 900,000) can be useful for the purposes of the present invention provided the aforesaid water solubility requirement and the requirement of incompatibility with the dry gelatin of the finished layer are satisfied.

It has also been found that the gelatin-incompatible dextran of the present invention can be used in mixture with a gelatin-compatible dextran of lower molecular weight and that this can be preferable in order not to have solutions with too high a viscosity. It has been found in particular that a mixture containing at least 25% by weight of gelatin-incompatible dextran in combination with a gelatin-compatible dextran of lower molecular weight reduces surface brightness to an extent substantially equal to that obtained by an equal quantity (by weight with respect to the mixture) of gelatin-incompatible dextran alone, with the advantage that the mixture has a viscosity that will not modify the viscosity of the gelatin solution of the protective layer.

It has been found that for the purposes of the present invention the second soft matting agent must be insoluble in water and in aqueous gelatin solutions. Particularly useful for the purposes of the present invention has proved to be a matting agent from the range of methacrylic esters (preferably polymethylmethacrylate), prepared by polymerization in dispersion in the form of substantially spherical pearl-like discrete particles with a smooth surface dispersed in the aqueous medium (these particles having a size of 0.5 to 20 and preferably 1 to 10 micrometers according to the variation in the parameters which govern polymerization in dispersion, i.e. the quantity and type of polymerization initiator, polymerization temperature, quantity and type of dispersing agent, and finally the type of stirring, as described for example for the polymethylacrylate in British Pat. No. 715,099).

It has also been found that the two soft matting agents used in performing the present invention must be incorporated into a determined thickness of external protective layer, and in certain quantities relative to each other and relative to the gelatin in order to modify the external profile and surface of the photographic element as heretofore described. Experiments show in particular that polyvinyl alcohols and high molecular weights dextran should be incorporated by means of aqueous solutions (from 0.5 to 30%) into the external protective layer in the photographic element of the present invention in quantities which will modify the surface of said external protective layer and reduce the reflecting power. In particular, the high molecular weight dextran should be present in said external protective layer in a quantity of 0.1 to 1.3 grams, preferably 0.3 to 1.0 grams per square meter, and in a proportion of 10% to 90%, and preferably 20% to 70% by weight with respect to the gelatin of the protective layer, said layer preferably having a thickness of between 0.5 and 2.0 microns, and more preferably of between 0.6 and 1.2 microns. The surface thus obtained comprises structural modifications which are not visible to the naked eye and cannot be measured by conventional surface roughness measuring instruments but which on microscopic examination with a magnification of 1200 times under phase contrast transparency show up as irregularities or disturbances in the form of ruptures or wrinkles of a size less than about 2 microns distributed uniformly and continuously over the entire surface.

It has been found that this surface is unique in improving the optical surface characteristics of the photographic element when observed after development; i.e. in appreciably reducing—without significant loss of transparency—the light reflected by the outer surface at the air-protective layer interface, which causes dazzling particularly in the higher density regions (this defect being particularly serious in the case of radiographic elements for use in radiography, the images of which have to be observed at length and with attention to detail).

The photographic element surface made non-bright according to the present invention has proved superior to that obtained by other agents normally used in the art, for example silica and starch. In this respect, it has been found that while silica reduces surface brightness, it projects from the element a profile of hard particles which make the element particularly abrasive. It has also been found that rice starch makes the outer surface opaque, with excessive worsening of turbidity in the layer, and thus disturbance to the vision of the element under transparency conditions. A further decisive advantage over the compounds used in the photographic art is that as high molecular weight dextran is water-soluble and compatible with the aqueous gelatin solutions of the protective layer, it gives rise to no separation or sedimentation phenomena, in contrast to the aforesaid agents which are insoluble both in water and in the aqueous gelatin solutions, thus providing an improved uniformity of the photographic layers which contain it. A further advantage of the use of dextran over the anti-brightness agents used in the art is that as it is perfectly soluble in gelatin solutions and in the spreading compositions of the protective layer, it does not clog the filters which are normally used for filtering solutions and compositions before spreading.

Experiments have also shown that the second soft matting agent should be introduced by means of aqueous dispersions (from 3 to 15%) into the protective layer of the photographic element according to the present invention in the form of approximately spherical water-insoluble discrete particles of a size between 1 and 10 micrometers, preferably between 2 and 6 micrometers in a quantity of 0.02 to 0.15 g, preferably 0.04 to 0.1 g per $m^2$, and in the proportion of 1% to 30%, and preferably 4% to 10% by weight, with respect to the gelatin of the protective layer, said protective layer having a thickness of between 0.5 and 2.0 micrometers as heretofore stated, and preferably between 0.6 and 1.2 micrometers. The surface thus obtained comprises rounded protuberances with project from the surface of the photographic element to a number of $5.10^3$ to $5.10^6$ per $cm^2$, so controlling its sliding characteristics and, together, preventing abrasion and tackiness (this being particularly desirable for example in the radiographic field when the sensitive element in plate form is used in rapid transport apparatus in which the plate is driven at high speed by means of rollers and passes in contact with reinforcing screens which exert a high pressure on it).

It has been found that such a surface, comprising ruptures or wrinkles and protuberances as described, has not only improved mechanical characteristics, but also improved surface optical characteristics in the photographically developed element, and a significant reduction in reflectance or brightness (without excessive loss of transparency), i.e. a reduction in the light reflected at the air-protective layer interface which causes dazzling which prevents observation of clear details, particularly in the higher density regions (this defect being particularly serious in the case of photographic elements for radiographic use, the images of which must be observed at length and with care in their details).

The described combination of the two soft matting agents has proved superior to the matting agent combinations already described or otherwise experimented by the applicant. For example, it has been found that the combination of a soft matting agent (for example, polymethylmethacrylate) and a hard matting agent (for example, silica) described in U.S. Pat. No. 3,411,907, although solving certain surface problems (especially retouching characteristics and to a certain extent surface brightness), modified the surface extremely abrasive towards other surfaces in contact with it. It has also been found that the combination of polymethylmethacrylate and another soft matting agent insoluble in water and in gelatin, such as rice starch, increased the number of protuberances projecting from the surface of the external protective layer to produce a reduction in brightness, but with an excessive worsening of turbidity (with a consequent disturbance of the element vision by transparency).

Brightness measurements were made in the examples using a normal parallel light reflectance measurer with the angle of incidence and measurement being 20° to the normal on elements exposed at maximum density and processed in a 3M XP-504 automatic processing machine in normal commercially available developing and fixing baths. The measured value was normalized so that a conventional silver mirror gave a brightness of 100 and an opaque black cloth a brightness of 0. Turbidity was measured as the difference between the density read in parallel transmitted light and the density read in diffused transmitted light with a densitometer normally used in the art on unexposed samples processed in the same XP-504 treatment machine with the same developing and fixing baths.

EXAMPLE 1

A silver bromo-iodide emulsion containing 2.2% of iodide, which had been matured physically and to which the normal spreading agents (anti-fog, stabilizers, hardeners, plasticizers and surface-active spreading agents) had been added was mixed with dextran having a molecular weight of 40,000 in order to increase the covering power of the silver, and was divided into three parts each of which was spread over the same substracted face of different parts of the same polyester support to give a covering of 2.9 g/$m^2$ of silver and 0.7 g/$m^2$ of dextran. A layer of gelatin (containing the normal coating adjuvants such as hardeners and surface-active agents) to which polymethylmethacrylate (PMMA) particles in a 6.5% aqueous dispersion stabilized with lauryl sulphate and having a size of 2 to 6 micrometers was spread over the first (A) of said three elements. A similar layer of gelatin containing the same PMMA in dispersion together with polyvinyl alcohol in a 3% aqueous solution was spread over the second (B) of said three elements (said polyvinyl alcohol, known as PVA 10/98, having a viscosity of about 10 cP at 20° C. in a 4% aqueous solution and a degree of saponification of 98%). A similar layer of gelatin containing the same PMMA in dispersion and the same PVA 10/98 in a greater quantity way spread over the third (C) of said three elements. After spreading, the elements were left to dry in a drying section associated with coating section, as is normal in the art. Samples of the elements A, B and C obtained after coating and drying as heretofore described were rolled up into stocks and made into plates for radiographic use, both with and without an interposed sheet of paper.

During their manufacture, make-up and use, the element A and the elements B and C showed good surface characteristics with regard to abrasion, tackiness and slidability. However, only samples B and C showed good brightness characteristics (with a tolerable amount of turbidity). The results given in Table 1 show the brightness characteristics obtained:

TABLE 1

| Element | Protective Layer Composition: Gelatin g/m² | PMMA g/m² | PVA (10/98) g/m² | Thickness (microns) | Brightness | Turbidity |
|---|---|---|---|---|---|---|
| A | 1.40 | 0.06 | — | 1 | 56 | 0.065 |
| B | 1.12 | 0.06 | 0.19 | 0.95 | 42 | 0.070 |
| C | 0.92 | 0.06 | 0.32 | 0.88 | 28 | 0.085 |

EXAMPLE 2

A silver bromo-iodide emulsion complete with the additions described in Example 1 was divided into three parts for spreading over the same substrated face of different parts of the same polyester support to give a covering of 2.9 g/m² of silver and 0.7 g/m² of dextran with a molecular weight of 40,000. The same protective layer as on the element A of Example 1 was spread over the first (A) of said elements. Over the second (B) of said elements, a similar gelatin layer was spread, but which in addition to PMMA contained dextran having an average molecular weight of 500,000 (Dextran 500) in a 20% aqueous solution. Over the third (C) of said elements, a similar layer of gelatin was spread, but which in addition to PMMA contained the same Dextran 500 but in a greater quantity. The elements A, B and C obtained after coating and drying were made up as described in Example 1. Both the element A and the elements B and C displayed good surface characteristics with regard to abrasion, tackiness and slidability. However, only elements B and C showed excellent brightness characteristics. The results given in Table 2 indicate the brightness characteristics obtained.

TABLE 2

| Element | Protective Layer Composition: Gelatin g/m² | PMMA g/m² | Dextran 500 g/m² | Thickness (microns) | Brightness | Turbidity |
|---|---|---|---|---|---|---|
| A | 1.4 | 0.06 | — | 1 | 40 | 0.06 |
| B | 0.86 | 0.06 | 0.34 | 0.9 | 30 | 0.06 |
| C | 0.92 | 0.06 | 0.39 | 1 | 25 | 0.07 |

EXAMPLE 3

A silver bromo-iodide emulsion complete with the additions described in Example 1 was divided into four parts for spreading over both the substrated faces of different parts of the same polyester support such that each face contained 2.9 g/m² of silver and 0.7 g/m² of dextran of molecular weight 40,000. A protective layer of gelatin containing PMMA particles and the additions given in Table 5 was spread over both the emulsion layers. The abrasion, slidability and tackiness characteristics were measured for the elements obtained, and were found to be good. The brightness and turbidity characteristics were also measured, and were found to be as given in the following Table:

TABLE 3

| Element | Protective Layer Composition: Gelatin g/m² | PMMA g/m² | Dextran 500 g/m² | Thickness (microns) | Brightness | Turbidity |
|---|---|---|---|---|---|---|
| A | 1.4 | 0.06 | — | 1 | 49 | 0.08 |
| B | 0.92 | 0.06 | 0.48 | 1 | 21 | 0.10 |
| C | 0.80 | 0.06 | 0.40 | 0.85 | 18 | 0.10 |
| D | 0.67 | 0.06 | 0.33 | 0.7 | 13 | 0.11 |

EXAMPLE 4

The element A of Example 1 was replicated as a comparison with other elements B, C, D, E and F prepared in the same manner, with the exception that in addition to PMMA, the protective layer also contained polyvinyl alcohols having a viscosity of 5 to 30 cP and a degree of saponification of 88 to 98% (PVA 5/98, PVA 10/98, PVA 30/98, PVA 5/88 and PVA 30/88), as listed in Table 3. Measurements were made on the abrasion, tackiness and friction characteristics, which were found good for all elements, and also on the brightness and turbidity characteristics, as described in Example 1. The brightness and turbidity as measured for the elements obtained are given in the following Table:

TABLE 4

| Element | Protective Layer Composition: Gelatin | PMMA | PVA Type | PVA g/m² | Brightness | Turbidity |
|---|---|---|---|---|---|---|
| A | 1.40 | 0.06 | — | 0.28 | 53 | 0.04 |
| B | 1.01 | 0.06 | 5/98 | 0.28 | 28 | 0.07 |
| C(*) | 1.01 | 0.06 | 30/98 | 0.28 | 20 | 0.07 |
| D | 1.01 | 0.06 | 5/88 | 0.28 | 37 | 0.08 |
| E(*) | 1.01 | 0.06 | 30/88 | 0.28 | 25 | 0.11 |
| F | 1.01 | 0.06 | 10/98 | 0.28 | 27 | 0.10 |

(*)On adding the aqueous solution of PVA 30/98 and PVA 30/88 to the gelatin solution, a slight turbidity was noted.

The invention is not limited to the particular emulsions of the preceding Examples, in that other emulsions can be similarly used such as simple or mixed emulsions of silver chloride, silver bromo-iodide, and silver chloro-bromide, both of fine and coarse grain, and prepared by various methods as described in Research Disclosure 18341, August 1979, paragraphs 1 A and 1 B. The emulsions can be chemically sensitized during or before chemical curing by adding sensitizing agents as described in Research Disclosure 18341, August 1979, paragraph 1C. The emulsions can contain stabilizing, anti-fog, development modification and anti-staining agents, agents which increase covering power, hardeners, plasticizers and anti-creasing agents as described in Research Disclosure 18341, August 1979, paragraphs II and II A-K. The emulsion can be sensitized spectrally, for example, in the wavelength region of the light emitted by the reinforcing screens in the case of elements used for radiography, as described in Research Disclosure 18341, August 1979, paragraphs IX and X. In addition, besides gelatin and its partial or total substituent, the protective layer can comprise dyes, plasticizers, anti-static agents and development accelerators as described in Research Disclosure 18341, August 1979, paragraph IV. The emulsion is preferably spread over a polyester support as described in Research Disclosure 18341, August 1979, paragraph XII, but other supports, for example, cellulose derivatives (cellulose nitrate, cellulose triacetate, cellulose propionate, cellulose acetate propionate, etc.), polyvinylchloride, polystyrene, polycarbonates, glass, paper etc. can be used. The photographic element according to the present invention can in addition comprise anti-static agents and layers as described in Research Disclosure 18341, August 1979, paragraph III.

The invention has been described in particular for black and white photographic elements, preferably for radiographic use. It is, however, not limited to said elements, and can also be used for color photographic elements comprising a plurality of silver halide emulsion layers sensitized towards different regions of the visible spectrum and containing color formers or coupling agents capable of forming dyes by chromogenic development of the exposed element with paraphenylenediamine developers.

We claim:

1. A photographic element comprising a support and a plurality of gelatin layers which comprise a silver halide emulsion layer and a non-photosensitive external protective gelatin layer, wherein the surface of said gelatin protective layer is modified by rupturing or roughness caused by the presence therein of a first water-soluble organic soft matting agent incompatible with gelatin having a water solubility at 23° C. of at least 0.5% by weight and by protuberances caused by the presence therein of a second water-insoluble organic soft matting agent, both of said soft matting agents having a hardness which does not exceed 4 on the Mohs scale.

2. A photographic element as claimed in claim 1, wherein said first and second matting agents are present in such quantities which reduce the reflectance and surface friction characteristics respectively.

3. A photographic element as claimed in claim 2, wherein said protective layer has a thickness between about 0.5 and about 2.0 microns.

4. A photographic element as claimed in claim 1, wherein said second soft matting agent is polymethylmethacrylate.

5. A photographic element as claimed in claim 3, wherein said second soft matting agent is polymethylmethacrylate.

6. a photographic element as claimed in claims 1, 4 or 5, wherein said first soft matting agent is polyvinyl alcohol.

7. A photographic element as claimed in claims 1, 4 or 5, wherein said first soft matting agent is dextran having a molecular weight between 100,000 and 900,000.

8. A photographic element as claimed in claims 2 or 3, wherein said first and second soft matting agents are present in quantities of 0.1 to 1.3 and, respectively, 0.02 to 0.15 grams per square meter of said protective layer.

9. A photographic element as claimed in claim 1, wherein said first and second soft matting agents are present in quantities of 0.1 to 1.3 and, respectively, 0.02 to 0.15 grams per square meter of said protective layer, and said second soft matting agent is polymethylmethacrylate and said first soft matting agent is selected from polyvinyl alcohol and dextran of molecular weight between 100,000 and 900,000.

10. A photographic element as claimed in claim 2, wherein said first and second soft matting agents are present in proportions of between about 10% and about 90% and, respectively, between about 1% and about 30% with respect to the gelatin of the protective layer.

11. A photographic element as claimed in claim 3, wherein said protuberances caused by the second water-insoluble soft matting agent have a size of between 1 and 10 microns.

12. A photographic element as claimed in claims 4 or 5, wherein said rupture or roughness caused by said first water-soluble soft matting agent incompatible with gelatin is distributed uniformly over the layer surface and has an average size of about 2 microns.

13. A photographic element as claimed in claim 3, wherein said soft matting agents are in the presence of agents which increase the covering power of the silver in said emulsion layer.

14. A method for controlling the surface characteristics of a photographic element comprising a support and a plurality of gelatin layers which comprise a silver halide emulsion layer and an external protective layer, wherein an aqueous gelatin composition is spread over the emulsion layer as a protective layer, and the spread protective layer is dried in order to give a surface comprising ruptures or roughness, and protuberances, said aqueous gelatin composition comprising gelatin and two organic soft matting agents as surface modifiers, the first water-soluble organic soft matting agent is incompatible with gelatin, having a water solubility at 23° C. of at least 0.5% by weight, and the second organic soft matting agent is water insoluble, both of said organic soft matting agents having a hardness which does not exceed 4 on the Mohs scale.

15. The photographic element of claims 1, 2, 3, 10 or 11 in which said first matting agent is selected from polyvinyl alcohol or dextran of molecular weight between 100,000 and 900,000 and said second matting agent is a methacrylic ester.

* * * * *